US007561119B2

(12) United States Patent
Kuyama

(10) Patent No.: US 7,561,119 B2
(45) Date of Patent: Jul. 14, 2009

(54) SCREEN IMAGE DISPLAY APPARATUS

(75) Inventor: Yoshikazu Kuyama, Tokyo (JP)

(73) Assignee: Fujitsu Frontech Limited (JP)

( * ) Notice: Subject to any disclaimer, the term of this patent is extended or adjusted under 35 U.S.C. 154(b) by 526 days.

(21) Appl. No.: 11/326,013

(22) Filed: Jan. 5, 2006

(65) Prior Publication Data

US 2006/0114173 A1 Jun. 1, 2006

Related U.S. Application Data

(63) Continuation of application No. PCT/JP03/09751, filed on Jul. 31, 2003.

(51) Int. Cl.
*G09G 3/20* (2006.01)
*G09G 5/00* (2006.01)

(52) U.S. Cl. ..... 345/56; 345/1.3

(58) Field of Classification Search ..... 345/56, 345/1.3, 204

See application file for complete search history.

(56) References Cited

U.S. PATENT DOCUMENTS

| | | | | |
|---|---|---|---|---|
| 4,386,351 | A * | 5/1983 | Lowdenslager | 345/56 |
| 5,966,115 | A | 10/1999 | Aoki | |
| 6,683,603 | B2 * | 1/2004 | Murai et al. | 345/204 |

FOREIGN PATENT DOCUMENTS

| | | |
|---|---|---|
| JP | 04207678 | 7/1992 |
| JP | 07152339 | 6/1995 |
| JP | 09006285 | 1/1997 |
| JP | 0950264 | 2/1997 |
| JP | 09190163 | 7/1997 |
| JP | 2000020042 | 1/2000 |
| JP | 200291382 | 3/2002 |
| JP | 2002111249 | 4/2002 |
| JP | 2002311932 | 10/2002 |
| JP | 20035278 | 1/2003 |
| JP | 2003162233 | 6/2003 |
| WO | WO-0203365 | 1/2002 |

OTHER PUBLICATIONS

"International Search Report for Application No. PCT/JP03/09751, date mailed Sep. 30, 2003", 2 pgs.
Korean Office Action from corresponding Korean patent application No. 10-2006-7001174, date mailed Nov. 29, 2006 (2 pages) with English translation (2 pages).
"Singapore Patent Application No. 200600150-7, Written Opinion mailed Nov. 8, 2007", 4 pgs.

* cited by examiner

*Primary Examiner*—Kevin M Nguyen
(74) *Attorney, Agent, or Firm*—Schwegman, Lundberg & Woessner, P.A.

(57) ABSTRACT

The present invention accomplishes a screen image display apparatus capable of changing a transfer direction of screen image signal freely. A master control 1 has a plurality of channels, with a signal line 2 being connected for transmitting a screen image signal so as to let each of the channels display a character or image. The signal line 2 is connected to a plurality of display blocks 3 by way of board-A, that is, signal transfer means. Each display block 3 comprises a board-A 4, that is, signal transfer means, a board-B 5, that is, signal supply means, and lamp units 6, that is, light emitting modules. And a screen image signal for causing the display block 3 to display a character or image is transferred from each channel of the master control 1 in a data transfer direction 7 via the signal line 2.

9 Claims, 19 Drawing Sheets

<BOARD-B AT FORWARD MOUNTING>

<BOARD-B AT REVERSE MOUNTING>

SCREEN IMAGE DISPLAY APPARATUS

CROSS-REFERENCE TO RELATED APPLICATIONS

This application is a continuation of International Application No. PCT/JP2003/09751, which was filed on Jul. 31, 2003.

FIELD OF THE INVENTION

1. Background of the Invention

The present invention relates to a screen image display apparatus comprising a plurality of light emitting modules.

2. Description of the Related Art

A display apparatus and signal transmission method therefor shown by FIG. 17 have conventionally been used for comprising a large scale display apparatus which is mounted on the roof or outer wall of a building for example.

As shown by FIG. 17, a large scale display apparatus comprises one screen by arranging a plurality of dot matrix units 40 having a certain number of pixels (e.g., 16 by 16 pixels or 8 by 8 pixels) lengthwise and breadthwise. FIG. 17 shows an outline view of a display apparatus in the case of arranging four pixel assembly units lengthwise for simplicity.

A screen image signal sent via a screen image signal cable 41 is inputted to a dot matrix unit 40 by way of an input signal-use connector 42. The inputted screen image signal is taken in by a circuit (not shown herein) within the dot matrix unit and then outputted from an output signal-use connector 43 by way of a driver IC. The screen image signal outputted from the output signal-use connector 43 is then inputted to an input signal-use connector 44 in the next matrix unit. The screen image signal will be transferred in a transfer direction 45 by repeating the same operation as described above.

FIG. 19 exemplifies a data format for a screen image signal feeding into a display apparatus comprising sixteen of the dot matrix units shown by FIG. 17. The data format shown by FIG. 19 is that of each pixel on the display screen with an applicable address added. A pixel address 47 shown by FIG. 19 is described by a hexadecimal with its third digit indicating a row number within the unit, the second digit indicating a unit number and the first digit indicating a column number within the unit. A data for each address is RGB data for example.

A screen image signal 48 is serial data which arrays data corresponding to pixels of each unit in the directions of leftward and upward, headed by a data with the address 0xFFF which is the data for the pixel located at the bottom right corner of the F-th number unit.

The screen image signal 48 is inputted to a zeroth number dot matrix unit 49 by way of an input-use connector 50. The inputted screen image signal 48 is transferred to the each unit in the directions of leftward and downward.

A Japanese laid-open patent application publication No. 09-006285 has disclosed the above described conventional technique for an LED display apparatus performing a high quality, high intensity display which can be used for a screen image of a television receiver or a VTR (video tape recorder).

Another Japanese laid-open patent application publication No. 2000-020042 has disclosed a screen image display system which is configured to display a screen image signal by arraying a plurality of screen image display apparatuses in a matrix.

Yet another Japanese laid-open patent application publication No. 2002-311932 has disclosed a screen image display apparatus which allocates a large scale screen for displaying a screen image and a large scale screen-use screen image transmission apparatus for transmitting a signal for screen image display which are configured remotely from each other.

Still another Japanese laid-open patent application publication No. 2003-162233 has disclosed a display apparatus comprising a plurality of light emitting modules, and a signal and signal/voltage transmission method therefor.

In the conventional display apparatus shown by FIG. 17, however, once a circuit for the unit (i.e., dot matrix unit 40) is designed to make a printed circuit board, the transmission direction of the signal is fixed permanently.

For instance, referring to FIG. 17, if an input-use connector is placed on the left side of the each dot matrix 40 and an output-use connector is on the right side thereof, the data will be transmitted from the connector on the left side in series (i.e., a la chain), a once established direction of data transfer (from the left to right in this case) cannot be changed. If a necessity arises, such as an installation condition, where there is a need to transmit the data from the right side with a controller installed on the right side, the dot matrix unit 40 must be redesigned and the printed circuit board must be produced again.

Meanwhile, if a connection is forced by using the current unit specification as shown by FIG. 18, a complex connecting configuration must be devised such as connecting a screen image signal cable 41 which comes from the right side with an input-use connector 44 located on the left side of the unit once and connecting a signal coming out of an output-use connector 43 on the right side with an input signal-use connector 42 on the left side on the next stage unit. Furthermore, a screen image signal (i.e., serial data) to be transferred to the display apparatus will also be complex.

Meanwhile, the received data is taken in by a circuit within each unit once and then transferred to the next stage unit by way of a driver IC, and therefore, if a problem occurs at an IC within any intermediary unit, the data transfer to the subsequent unit becomes impossible.

Moreover, if a condition requires a much larger pixel pitch, making a dot matrix unit from sixteen by sixteen pixel units or eight by eight pixel units as is conventional becomes increasingly difficult in terms of production engineering. Accordingly, there is a common method by the name of cluster lamp to array lamp units by the unit of pixel, but this method not only increases the number of cables, et cetera, but also requires a waterproof box or boxes for protecting them.

The problems of the above described conventional screen image display apparatuses have a difficulty of changing the once established data transfer direction, and a complexity of an apparatus structure and transferring a screen signal if it is attempted to forcibly change the data transfer direction.

The purpose of the present invention is to solve such problems inherent in the conventional configuration and accomplish a screen image display apparatus capable of freely changing the transfer direction of a screen image signal.

SUMMARY OF THE INVENTION

According to an embodiment of the invention, a screen image display apparatus, in the one comprising a plurality of display blocks arrayed in a prescribed direction with each of the plurality of display blocks including a plurality of light emitting modules, comprises a signal supply unit for supplying serially the plurality of light emitting modules with a signal so as to cause the light emitting modules to display a character or image, and a signal transfer unit for transferring the signal supplied for one display block to the signal supply unit for the one display block and another of the display units, wherein the signal supply unit comprises, for each of the display blocks, a first signal supply unit for supplying the light emitting module with the signal transferred from one transfer direction, a second signal supply unit for supplying the light emitting module with the signal transferred from another transfer direction, and a switching unit for switching between the first and second signal supply units.

An embodiment of the invention renders a benefit of enabling supply of a signal to the light emitting module independent of a transfer direction of the signal by the switching unit, switching between the first signal supply unit for supplying the light emitting module with the signal transferred from one transfer direction and a second signal supply unit for supplying the light emitting module with the signal transferred from another transfer direction.

According to an embodiment of the invention, the screen image display apparatus is characterized by the switching unit comprising an optical sensor for detecting whether or not there is an obstacle close to the rear surface of the display apparatus, wherein either the first or second signal supply unit is switched on automatically based on a signal detected by the optical sensor.

An embodiment of the invention renders a benefit of enabling a detection of an obstacle, such as a building wall behind the display apparatus, by using the optical sensor to switch automatically between a first signal supply unit for supplying the light emitting module with the signal transferred from one transfer direction and a second signal supply unit for supplying the light emitting module with the signal transferred from another transfer direction and enabling a supply of the signal to the light emitting module independent of a transfer direction of the signal.

According to an embodiment of the invention, the screen display apparatus is characterized by the switching unit comprising a pressure sensor for detecting whether or not an obstacle is against the rear surface of the screen display apparatus, wherein either the first or second signal supply units is switched on automatically based on a detection signal of the pressure sensor.

An embodiment of the invention renders a benefit of enabling a detection of an obstacle, such as a building wall, against the back of the display apparatus by using the pressure sensor to switch automatically between the first signal supply unit for supplying the light emitting module with the signal transferred from one transfer direction and a second signal supply unit for supplying the light emitting module with the signal transferred from another transfer direction thus enabling a supply of the signal to the light emitting module independent of the transfer direction of the signal.

According to an embodiment of the invention, a screen image display apparatus, in the one comprising a plurality of display blocks arrayed in a prescribed direction with each of the plurality of display blocks including a plurality of light emitting modules, comprises a signal supply unit for supplying serially the plurality of light emitting modules with a signal for causing the light emitting modules to display a character or image, and a signal transfer unit for transferring the signal supplied for one of the display blocks to the signal supply unit for the one display block and another of the display blocks, wherein the signal transfer unit comprises, for each of the display blocks, a first signal transfer unit for transferring the signal transferred from one transfer direction to the signal supply unit for the display block itself and the next display block, a second signal transfer unit for transferring the signal transferred from another transfer direction to the signal supply unit for the display block itself and the next display block, and a switching unit for switching between the first and second signal transfer units.

An embodiment of the invention renders a benefit of enabling a change of the signal transfer direction by allowing the switching unit switch between the first signal transfer unit for transferring the signal transferred from one transfer direction to the signal supply unit for the display block itself and the next display block, and the second signal transfer unit for transferring the signal transferred from another transfer direction to the signal supply unit for the display block itself and the next display unit.

BRIEF DESCRIPTION OF THE DRAWINGS

The present invention will be more apparent from the following detailed description when the accompanying drawings are referred to.

Figure 1:
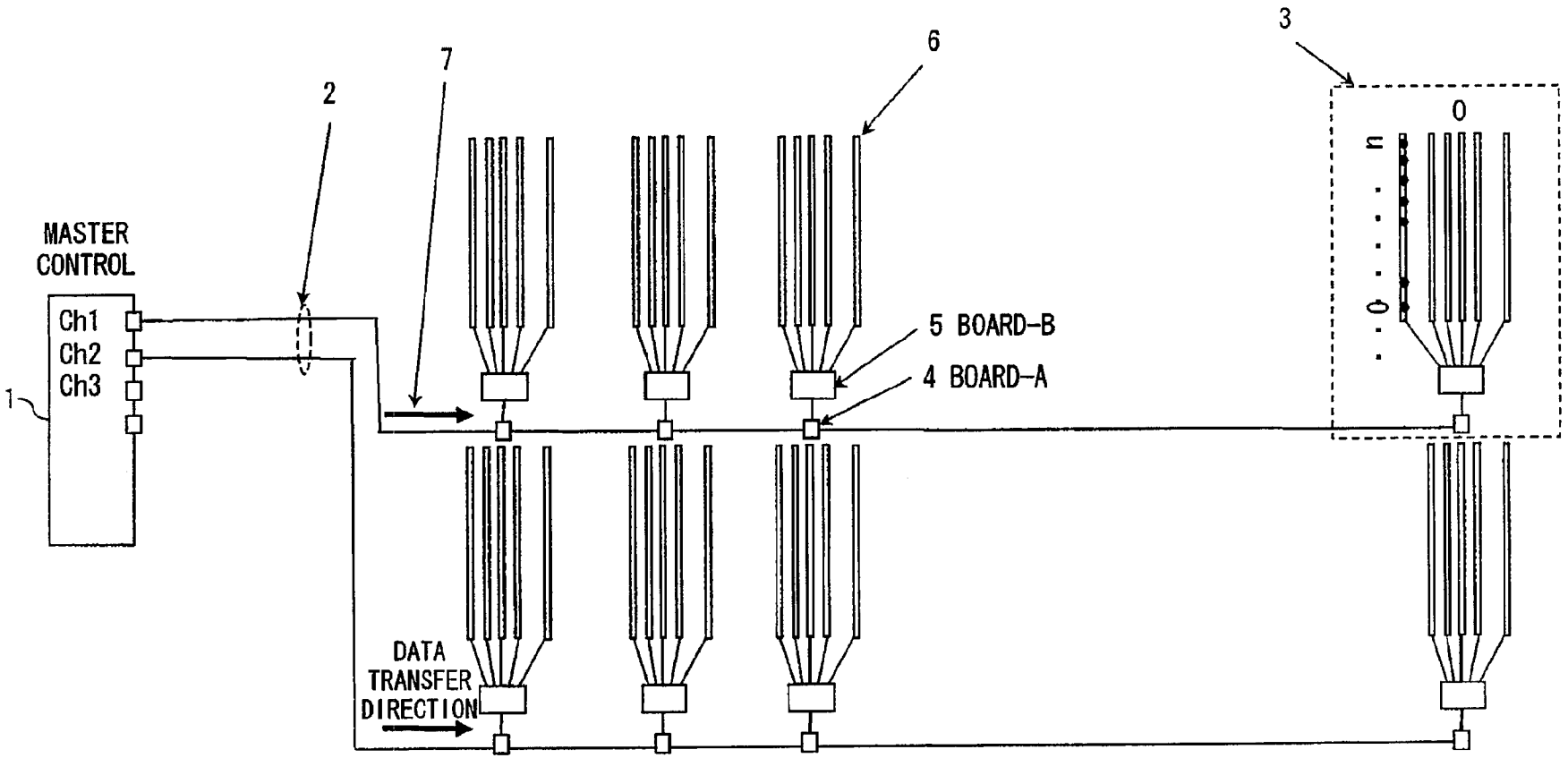
FIG. 1 illustrates an embodiment of the present invention.

1: master control
2: signal line
3: display block
4: board-A

5: board-B
6: lamp unit
60: lamp unit connected to channel 0
61: lamp unit connected to channel 1
6F: lamp unit connected to channel F
7: data transfer direction
8: memory
9: drive IC
10: light emitting element
11: screen image signal data
12: data transmission direction
13: V sync
14: screen image signal data
15: clock
16: data count unit
17: comparator
18: memory selector
19: position setup switch
20: AND circuit
21: reversing switch
22: selector
23: memory
230: channel 0-use memory
231: channel 1-use memory
23F: channel F-use memory
24: board-B mounted with its surface facing forward
25: board-B mounted with its surface facing backward
26: wall
27: display surface
28: building
29: back side of display apparatus
30: board-B in reverse
31: channels in reverse
32: screen image signal input unit
33: for-board-B screen image signal output unit
34: for-next stage display block screen image signal output unit
35: switch
36: screen image signal I/O unit A
37: screen image signal I/O unit B
38: for-board-B screen image signal output unit
39: board AB

DESCRIPTION OF THE PREFERRED EMBODIMENTS

The following description is of a preferred embodiment of the present invention referring to the accompanying drawings of FIGS. 1 through 16.

FIG. 1 illustrates an embodiment of the present invention. A master control 1 has a plurality of channels, with each of the channels (e.g., Ch 1, Ch 2, Ch 3 shown by FIG. 1) being connected to a signal line 2 for transmitting a screen image signal so as to display a character or image. The signal line 2 is connected to a plurality of display blocks 3 via a board-A 4 which is a signal transfer unit. Each display block 3 comprises a board-A 4 which is a signal transfer unit, a board-B 5 which is a signal supply unit, and a lamp unit 6 which is a light emitting module. And a screen display signal for the display block 3 to display a character or image is sent from each channel of the master control 1 in the data transfer direction 7 via the signal line 2.

Figure 2:
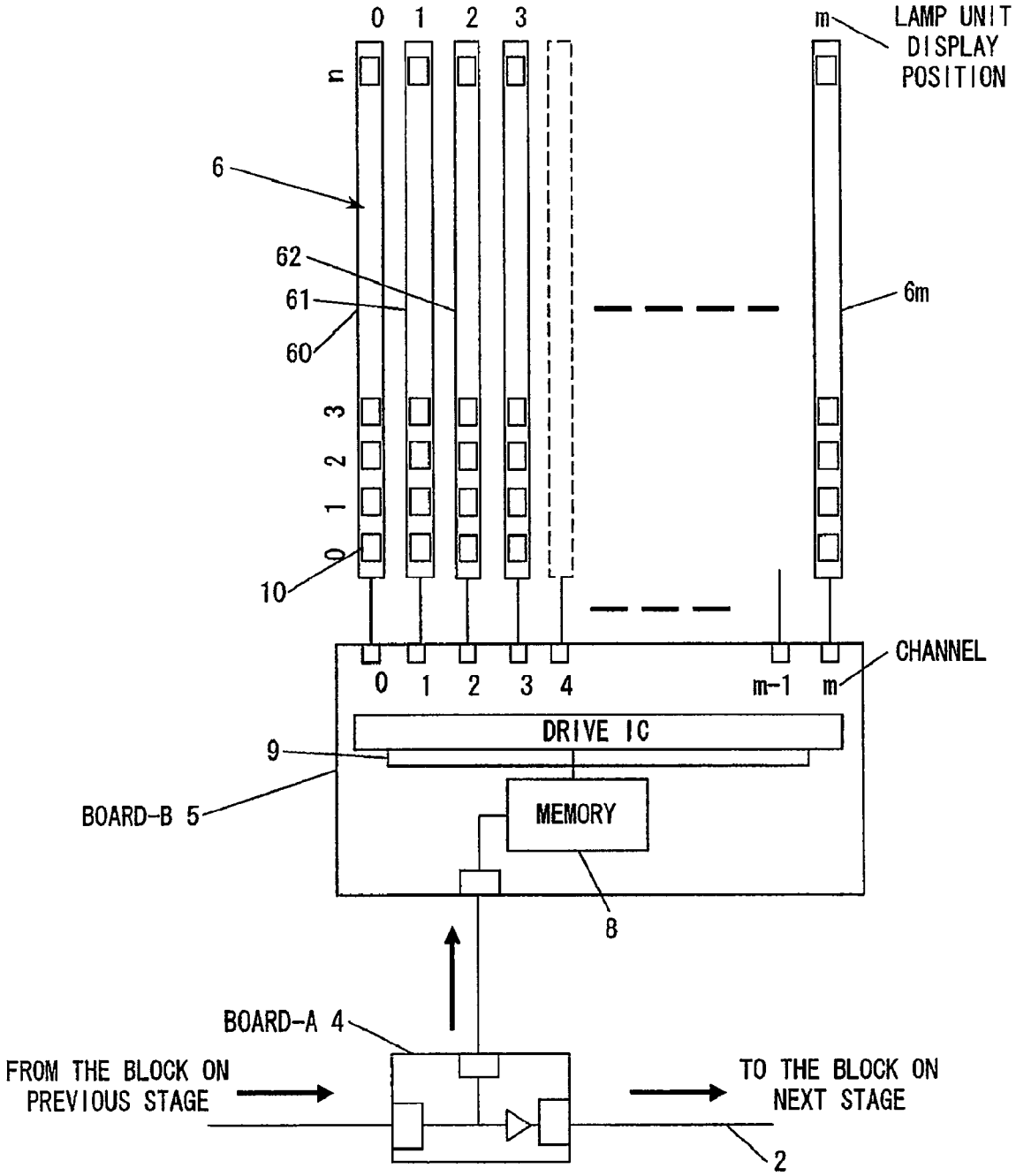
FIG. 2 shows a display block used for the present embodiment.

FIG. 2 shows the display block 3 used for the present embodiment. The board-A 4 connected to the signal line 2 only has the function of transferring a screen image signal sent from the master control 1 to the board-B 5 and the next display block 3. This makes the structure simple so as to minimize failure occurrence and hence lighten maintenance work.

The board-B 5 comprises a memory 8 for obtaining necessary data for the current display block 3 from the data sent from the board-A 4 and recording the obtained data, and a drive IC circuit 9 for making each lamp unit 6 display data recorded by the memory 8; and further comprises channels for connecting with the lamp unit 6. FIG. 2 exemplifies a case of the board-B 5 having channels 0 (zero) through m.

The lamp unit 6 is connected to the board-B 5 by way of each channel comprised thereby. FIG. 2 exemplifies the case of m-number of lamp units connected to the board-B 5. Each lamp unit 6 connected to the board-B comprises a plurality of light emitting elements 10 (NB: FIG. 2 shows the case of n-number of light emitting elements). The light emitting elements 10 comprise a combination of LED (light emitting diode), et cetera, corresponding to R (red), G (green) and B (blue) in order to display RGB data for example.

Here, the screen image signals are transferred from the left to the right and from the top to the bottom. Therefore, a screen image is transferred in a sequence of lamp units 60, 61 and 62 as shown by FIG. 2. In this case, a connecting position of a lamp unit 6 relative to the board-B 5 is defined as a lamp unit display position in the following description. For example, the lamp unit display position of the lamp unit 60 is "0", that of the lamp 61 is "1" and that of the lamp unit 6*m* is "m".

The memory 8 records a screen image signal required for each lamp unit in a sorted fashion, for instance, for the lamp unit 60 at channel 0, the data corresponding to the light emitting elements 0 through n within the lamp unit and for the lamp unit 61 at channel 1, the data corresponding to the light emitting elements 0 through n within the lamp unit.

Furthermore, the memory 8 is comprised by two memories, so that a recording and a reading processing are carried out alternately. While a screen image data is being recorded in one memory, an already recorded screen image is being read out of the other memory for transferring the data to each lamp unit.

Figure 3:
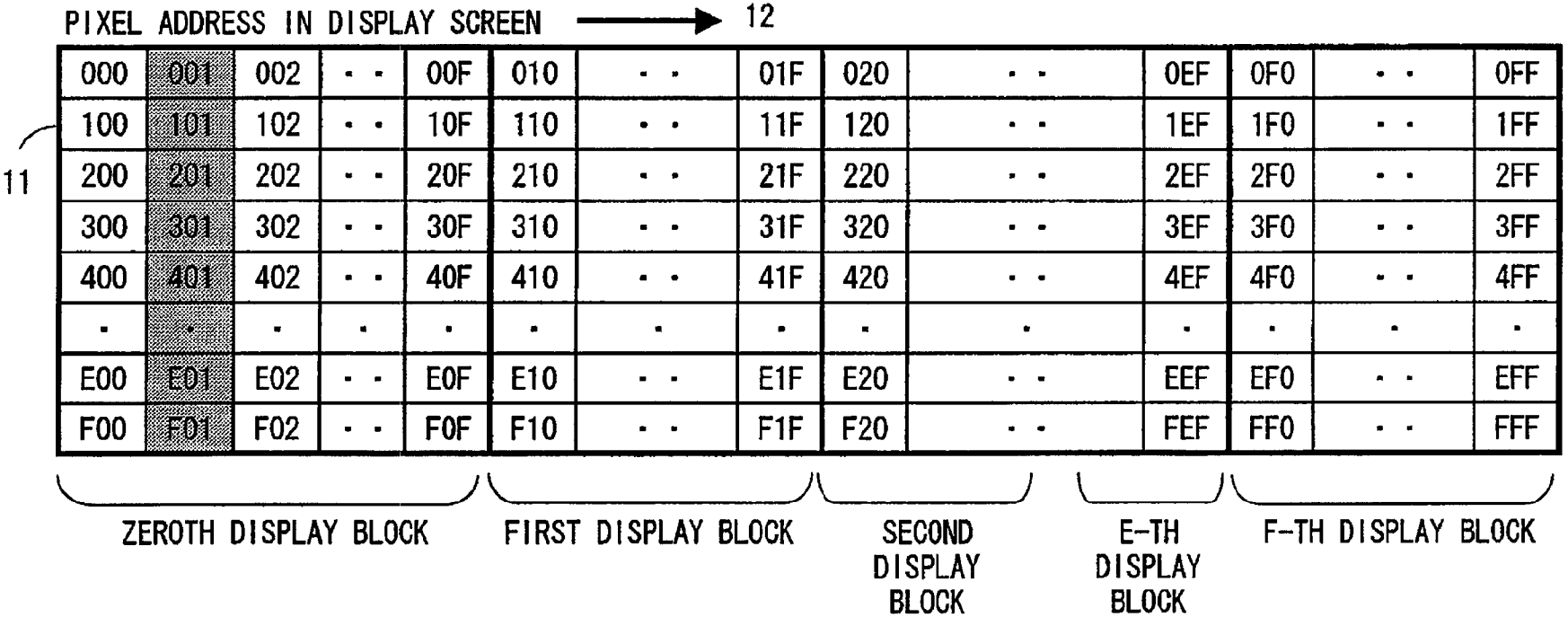
FIG. 3 exemplifies a data format for a screen display signal sent from a master control to a display apparatus.

FIG. 3 exemplifies a data format for a screen display signal sent from a master control 1 to a display apparatus. FIG. 3 exemplifies a format for a screen image signal data when transferring a screen image to the display apparatus comprising a display screen of 256 (Horizontal) by 16 (Vertical) pixels, that is, shows a format for a screen display signal data in order to display a screen image in a display apparatus comprising a lamp unit 6 comprising sixteen light emitting elements 10, a display block 3 comprising sixteen lamp units 6 and sixteen display blocks 3.

A screen image data is temporarily stored in a memory within the master control 1 for example and forms a screen image data 11 according to the number of pixels constituting a display screen comprised by the display apparatus. The hexadecimal numbers written in the screen image data 11 shown by FIG. 3 indicate pixel addresses. A pixel address indicates a position of a light emitting element 10 within the display apparatus (i.e., a position of a light emitting element 10 when viewing the display apparatus from the display surface). For example, the pixel addresses 0x000 through 0xF00 are data (e.g., RGB data) designated to be displayed by each pixel of the lamp unit 6 in the zeroth (i.e., lamp unit in the channel 0 (zero)) display block from the left of the display screen. Likewise, the pixel addresses 0x0FF through 0xFFF are the data designated to be displayed by the lamp unit 6 in the sixteenth (0xF) (i.e., lamp unit in the channel F) display block from the left of the display screen.

The screen image data 11 is transmitted serially in the direction of a data transmission direction 12 with the pixel address 0x000 at the head. That is, the screen image data 11 is divided and transmitted serially in the sequence of the left to the right and the top to the bottom. In the example shown by FIG. 3, among screen image data 11 to be displayed by the display apparatus, the screen image data 11 (i.e., screen image data with the pixel address 0x000 at the head, followed by 0x001, 0x002 through 0x0FF) to be displayed by the light emitting elements 10 in the top most row (i.e., the first row) is transmitted first, followed by the screen image data 11 (pixel addresses 0x100, 0x101, 0x102 through 0x1FF) to be displayed by the light emitting elements 10 in the second row. Likewise, the screen image data of the pixel addresses through 0xFFF will be transmitted.

Figure 4:
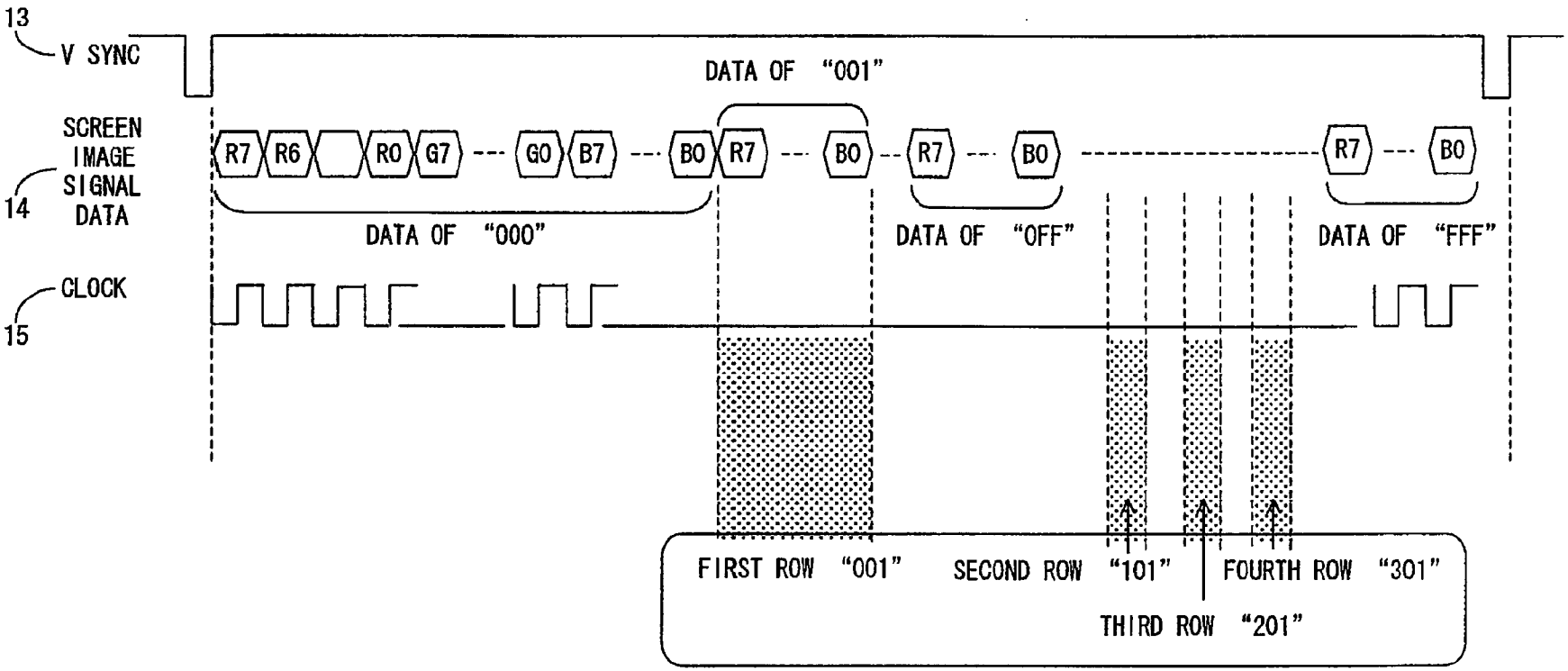
FIG. 4 illustrates a screen image signal transmitted from a master control.

FIG. 4 illustrates a screen image signal transmitted by the master control 1. A transfer process is carried out by three categories of signals, i.e., a V sync 13 (a signal segmenting one screen image (i.e., one frame) of a screen image signal), a screen image signal data 14 (a serial signal of 8-bits worth of gradation data for each of R, G and B) and a clock signal 15. As shown by FIG. 4, the screen image data 11 for one frame (i.e., one screen image) of a screen image is transmitted synchronously with the V sync 13. And each data of screen image data 11 is transmitted synchronously with the clock signal.

The screen image signal data 14 is transferred serially as shown by FIG. 3. The data for each pixel address of the screen imaged at all is RGB data for example, with each data, i.e., R (red), G (green) and B (blue), being 8-bit data. That is, a data representing the RGB of pixel address 0x000 is transmitted in sequence of signals R7, R6 through R0 for expressing R (red), followed by in sequence of signals G7, G6 through G0 for expressing G (green), all synchronously with the V sync as shown by FIG. 4. Further followed by signals expressing B (blue) in sequence of B7 through B0. Likewise, the data for pixel addresses up to 0xFFF will be transferred in series.

The serially transferred data is then parallel-converted by the board-B 5 of the display block 3 and each color (i.e., RGB) is recorded by the memory 8 with an 8-bit bus width.

Figure 5:
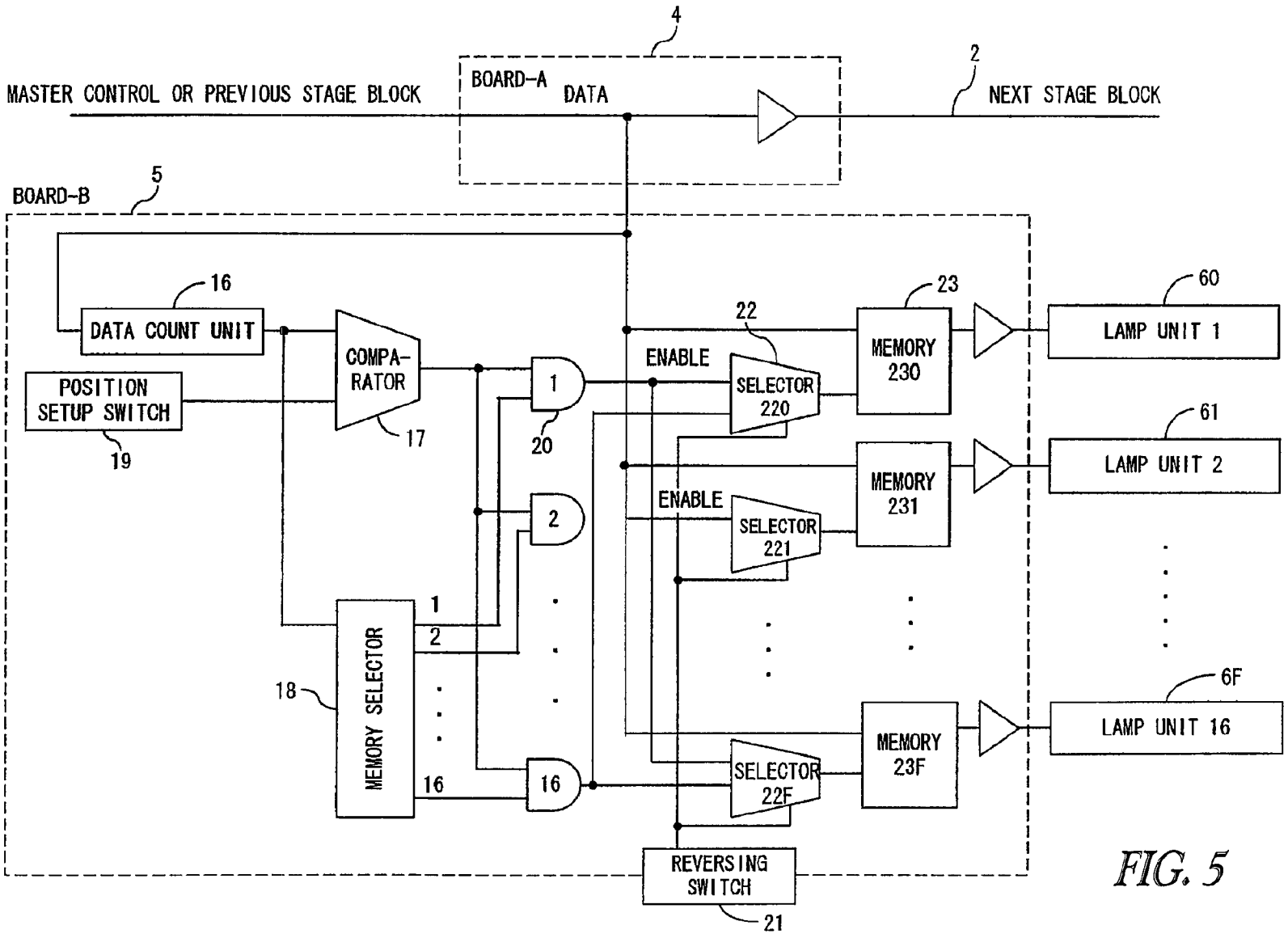
FIG. 5 shows an example comprisal of board-B used in an embodiment according to the present invention.

FIG. 5 shows an example comprisal of board-B 5 used for an embodiment according to the present invention. The board-B 5 is connected to the signal line 2 by way of the board-A 4. The signal line 2 from the board-A 4 is connected to a data count unit 16 for counting an input signal, i.e., a screen image signal, and to a memory 23 (i.e., memory 23 for each channel) which is connected with each lamp unit 6 (FIG. 5 shows an example of sixteen lamp units connected) that is connected to the board-B 5.

A comparator 17 receives inputs from the data count unit 16 and a position setup switch 19, respectively, and outputs a comparison result to each of sixteen AND circuits 20 accordingly. Here, the position setup switch 19 is configured for recognizing a display block itself by using a dip switch, et cetera, in advance. Therefore, the control of the comparator is such as to acquire only an input signal necessary for displaying in the display block itself.

An output signal from the data count unit 16 is then outputted to each of the sixteen AND circuits 20 by way of a memory selector 18 (i.e., a 16-stage decoder for selecting memory).

Each AND circuit 20 produces a logical product of respective signals from the comparator 17 and memory selector 18 to output to each selector 22. Each selector 22 receives signals from the AND circuit 20 (i.e., enable signal) and reversing switch 21, i.e., switching means, to output a write control signal to the memory 23.

The memory 23 for each channel receives a screen image signal from the board-A4 and a memory-write control signal from the selector 22 to record the screen image signal in compliance with the memory-write control signal. The screen image signal recorded by the memory 23 will be sent out to the lamp unit 6 to become a screen display.

Here, the reversing switch 21 is disposed for switching between normal and reverse modes. When the reversing switch 21 is in the normal mode, a screen image signal data is recorded in ascending sequence, beginning with the memory 230 for the channel 0 (zero). For example, when recieving data of pixel addresses 0x000 through 0x00F of the screen image signal data 11 shown by FIG. 3, the memory 230 for the channel 0 will record the data with the pixel address 0x000. Likewise, the memory 231 through 23F for the channels 1 through F, respectively, will record the screen image signal data 11 with the addresses 0x001 through 0x00F, respectively.

When the reversing switch 21 is in the reverse mode, a screen image signal data is recorded in descending sequence, beginning with the memory 23F for the channel F. For example, when recieving data of pixel addresses 0x000 through 0x00F of the screen image signal data 11 shown by FIG. 3, the memory 23F for the channel F will record the data with the pixel address 0x000. Likewise, the memory 23E through 230 for the channels E through 0 (zero), respectively, will record the screen image signal data 11 with the addresses 0x001 through 0x00F, respectively.

Figure 6:
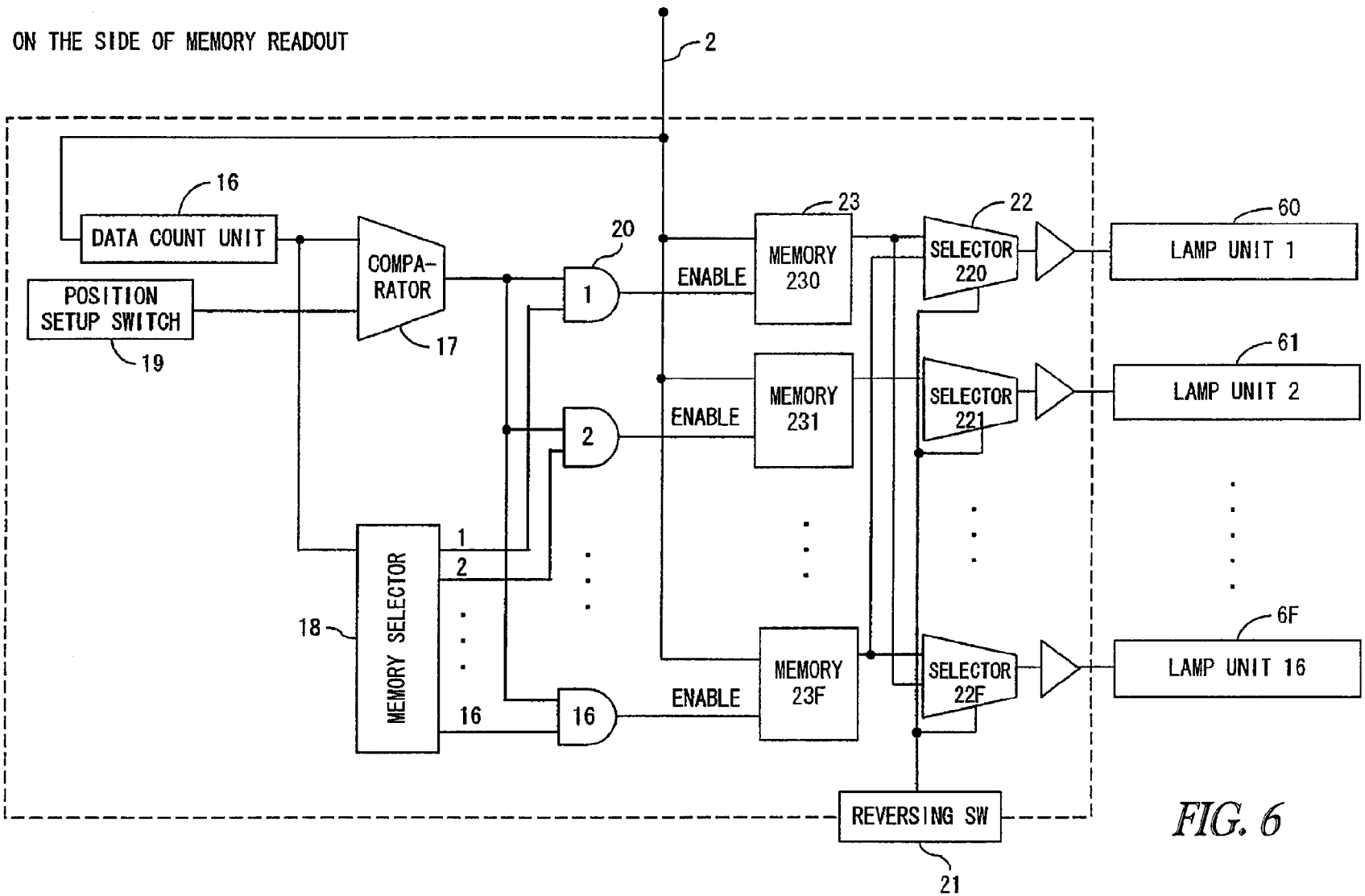
FIG. 6 shows another example comprisal of board-B used in an embodiment according to the present invention.

Note that the board-B 5 used for the preferred embodiment of the present invention has adopted the circuit configuration shown by FIG. 5, however other configurations are possible as long as they have a mechanism for changing the lamp unit display positions (a la mechanism of the reversing switch 21), including for example, a circuit configuration as shown by FIG. 6.

Referring to FIG. 6, the board-B5 is connected to the signal line 2 by way of the board-A 4. The signal line 2 is connected to a data count unit 16 for counting an input signal, i.e., a screen image signal, and to a memory 23 (i.e., memory 23 for each channel) which is connected to each lamp unit 6 (FIG. 6 shows an example of sixteen lamp units connected) that is connected to the board-B 5.

A comparator 17 receives inputs from the data count unit 16 and a position setup switch 19, respectively, and accordingly outputs a comparison result to each of sixteen AND circuits 20. An output signal from the data count unit 16 is then outputted to each of the sixteen AND circuits 20 by way of a memory selector 18.

The memory 23 receives a signal (i.e., enable signal) from each AND circuit 20 and a screen image signal from the board-A 4 to record the screen image signal therein, in compliance with the enable signal.

The screen image signal recorded by the memory 23 is sent out to a lamp unit 6 selected by the reversing switch 21. When the reversing switch 21 is in the normal mode, the screen image signal data 11 recorded by the memories 230 through 23F are outputted in ascending sequence, beginning with the lamp unit 60. For example, the screen image signal data 11 recorded by the memory 230 is outputted to the lamp unit 60, and the one recorded by the memory 231 is outputted to the lamp unit 61.

On the other hand, when the reversing switch 21 is in the reverse mode, the screen image signal data 11 recorded by the memory 230 through 23F are outputted in descending sequence, beginning with the lamp unit 6F. For example, the screen image signal data 11 recorded by the memory 230 is outputted to the lamp unit 6F, and the one recorded by the memory 23F is outputted to the lamp unit 60.

Figure 7:
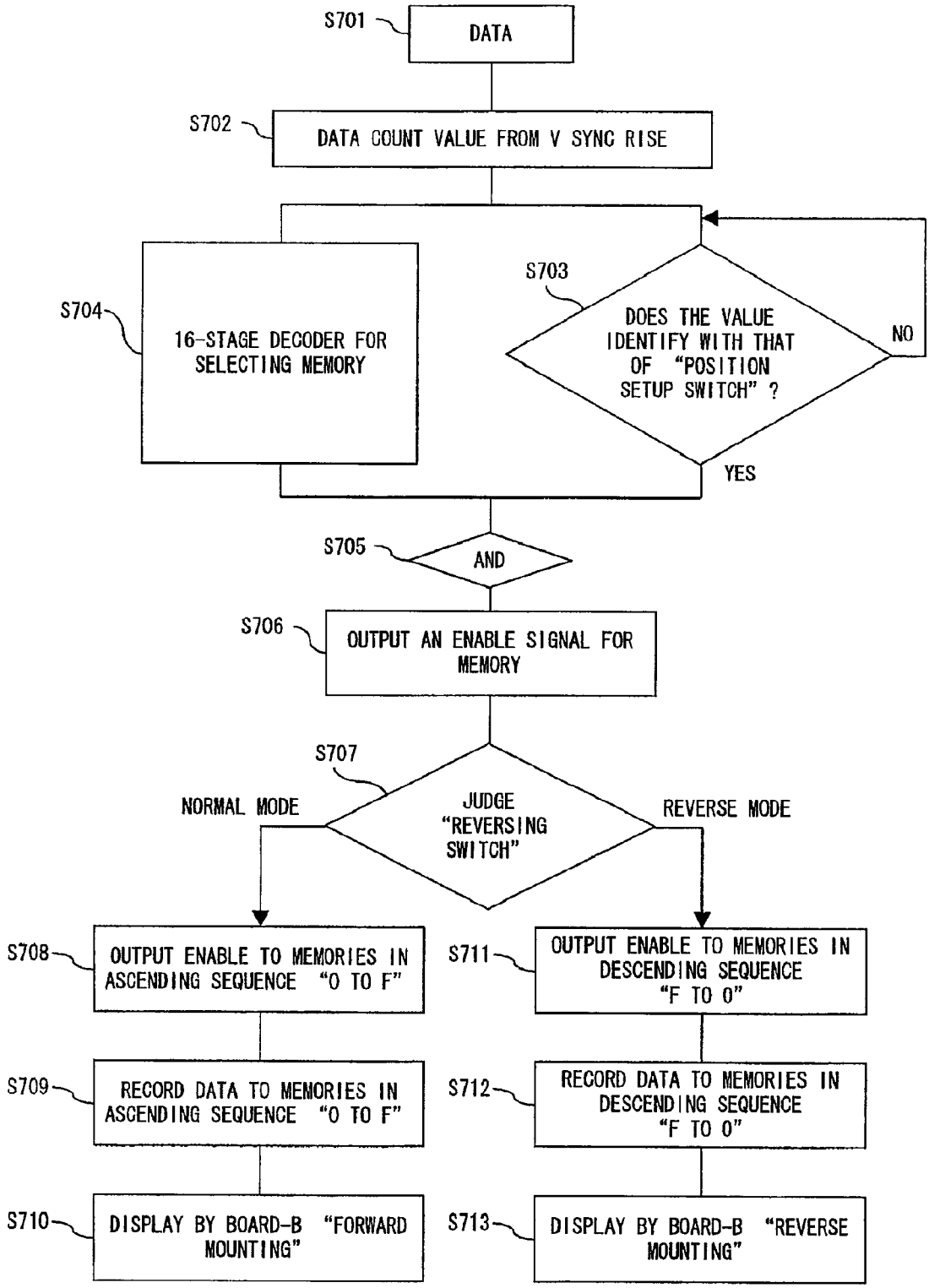
FIG. 7 is a flow chart showing a summary of processing of the board-B used in the present embodiment.
Figure 8:
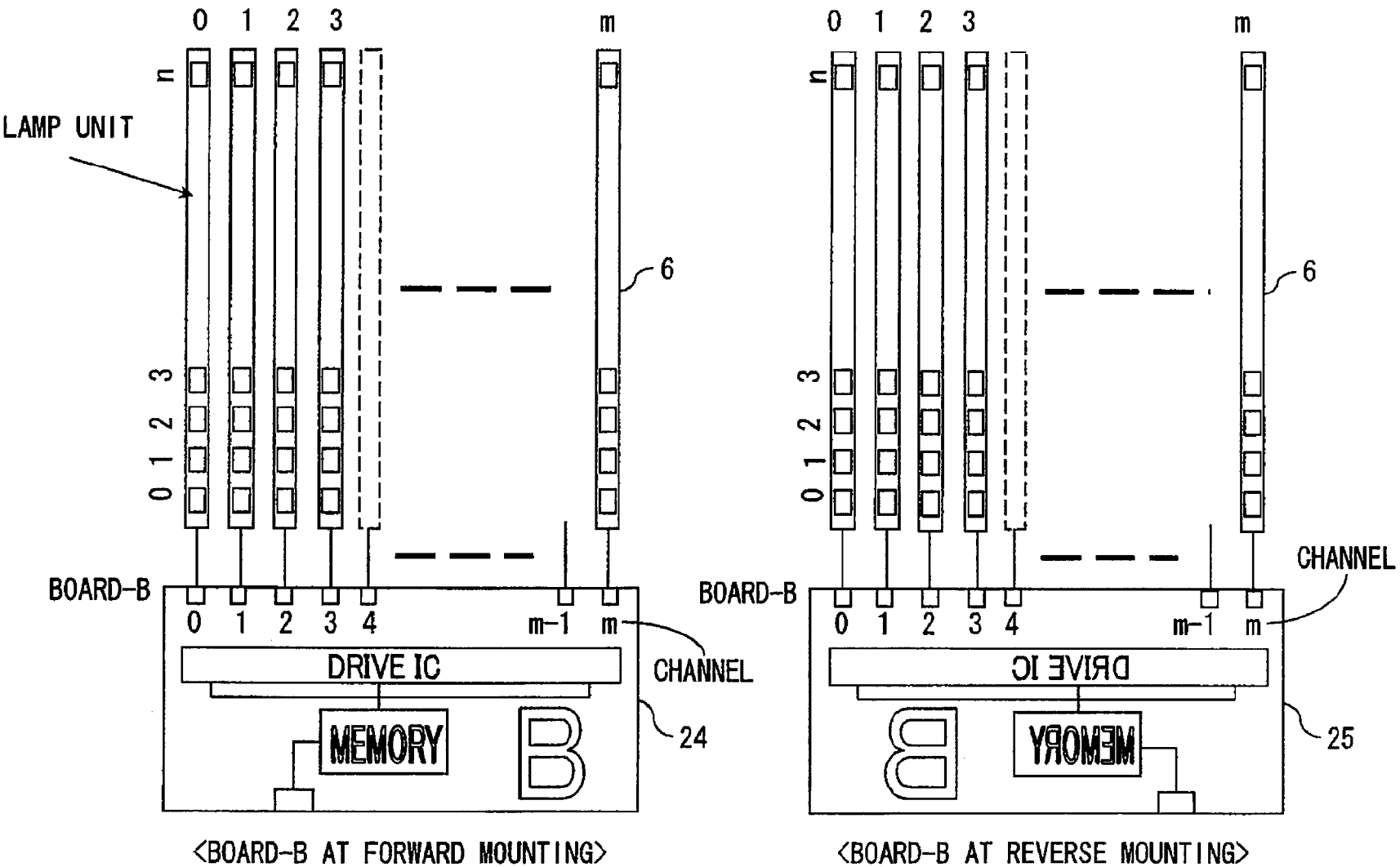
FIG. 8 shows mounting the board-B onto a display apparatus with its front facing forward and mounted in reverse.

FIG. 7 is a flow chart showing a summary of processing at the board-B shown by FIG. 5. As the board-B 5 receives a screen image signal sent from the board-A 4 (step S701) (simply "S701" hereinafter unless otherwise noted), the data count unit 16 starts counting data at a V sync rising edge (S702). The comparator 17 compares the count value with a value of the position setup switch 19 which has been set by a dip switch for example (S703).

The comparator 17 becomes active only when the count value identifies with that of the position setup switch 19. Meanwhile, the memory selector 18, i.e., a sixteen-stage decoder for selecting memory, decodes the screen image signal inputted by way of the data count unit 16 (S704) to output to each AND circuit 20 which then produces a logical product of input signals from the comparator 17 and memory selector 18 (S705).

The result of the logical operation by the each AND circuit 20 is used as an enable signal for controlling memory and inputted to the each selector 22 (S706). The selector 22 then switches itself between the normal and reverse modes as a result of receiving an input from the reversing switch 21 (S707).

During the normal mode, the selectors 220 through 22F output enable signals to the respective channel-use memory 23 in ascending sequence (i.e., output enable signals to the memory 230 through 23F in ascending sequence; S708). Accordingly, the screen image signal inputted to the board-B 5 is recorded by the memory 230 through 23F in ascending sequence (S709). The screen image signal data recorded by the memory 23 is transmitted to the lamp units 60 through 6F as screen image signals to become a screen image display (S710).

Conversely in the reverse mode, the selectors 22F through 220 output enable signals to the respective channel-use memory 23 in descending sequence (i.e., output enable signals to the memories 23F through 230; S711). Accordingly, the screen image signal inputted to the board-B 5 is recorded by the memory 23F through 230 in descending sequence (S712). The screen image signal data recorded by the memory 23 is transmitted to the lamp units 6F through 60 as screen image signals to become a screen image display (S713).

As described above, the board-B 5 is capable of switching channels thereof by switching the reversing switch 21. Therefore, if the board-B 5 is installed backwards vis-à-vis the display surface, the channels are reversed (refer to the board-B 25 in the reverse mounting shown by FIG. 8) by switching channels through the reversing switch 21, thereby making it possible to display a screen image (in ascending sequence) from the lamp unit 6 on the left side (i.e., the lamp unit 6 connected to the channel 0) in the same way as if the board-B 5 were installed facing forward vis-à-vis the display surface (refer to the board-B 24 in the forward mounting also shown by FIG. 8).

Therefore, a change of the function of the master control 1 (i.e., a change of data format for transferring data) is not required when mounting the board-B 5 either facing forward or backward vis-à-vis the display apparatus.

Figure 9:
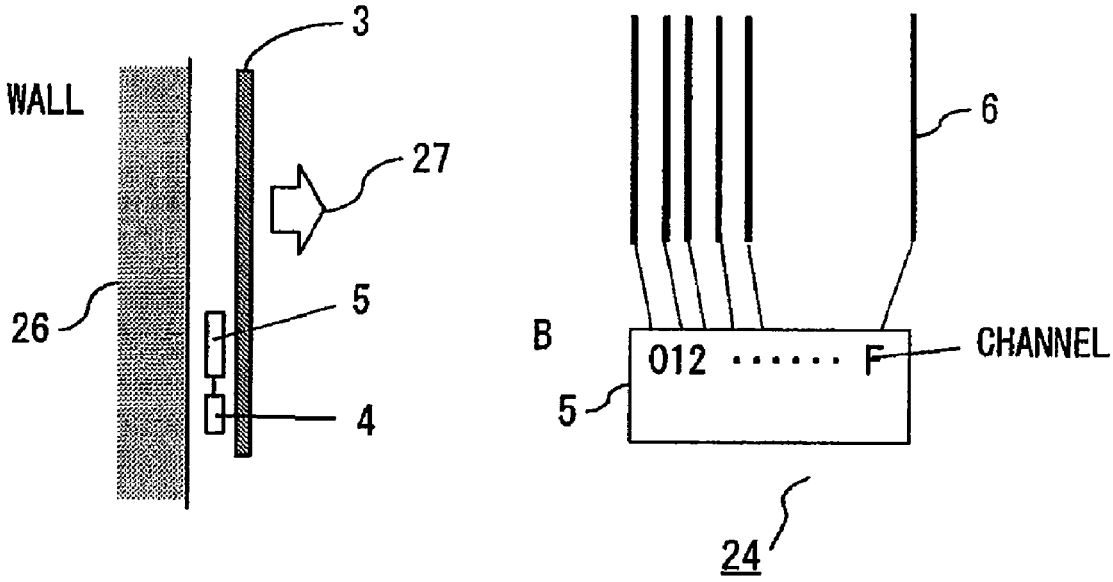
FIG. 9 shows an example installation with the board-B mounted onto a display apparatus with the front facing forward.

FIG. 9 shows an example installation with the board-B 24 being mounted with the front facing forward onto a display apparatus. When mounting a display apparatus on a wall 26, the maintenance of board-A 4 and board-B 5 will be performed from the display surface 27. Therefore, the board-B 5 is to be mounted as the board-B 24 being installed with the front facing forward vis-à-vis the display apparatus. In this case the reversing switch 21 of the board-B 5 is set for the normal mode.

Figure 10:
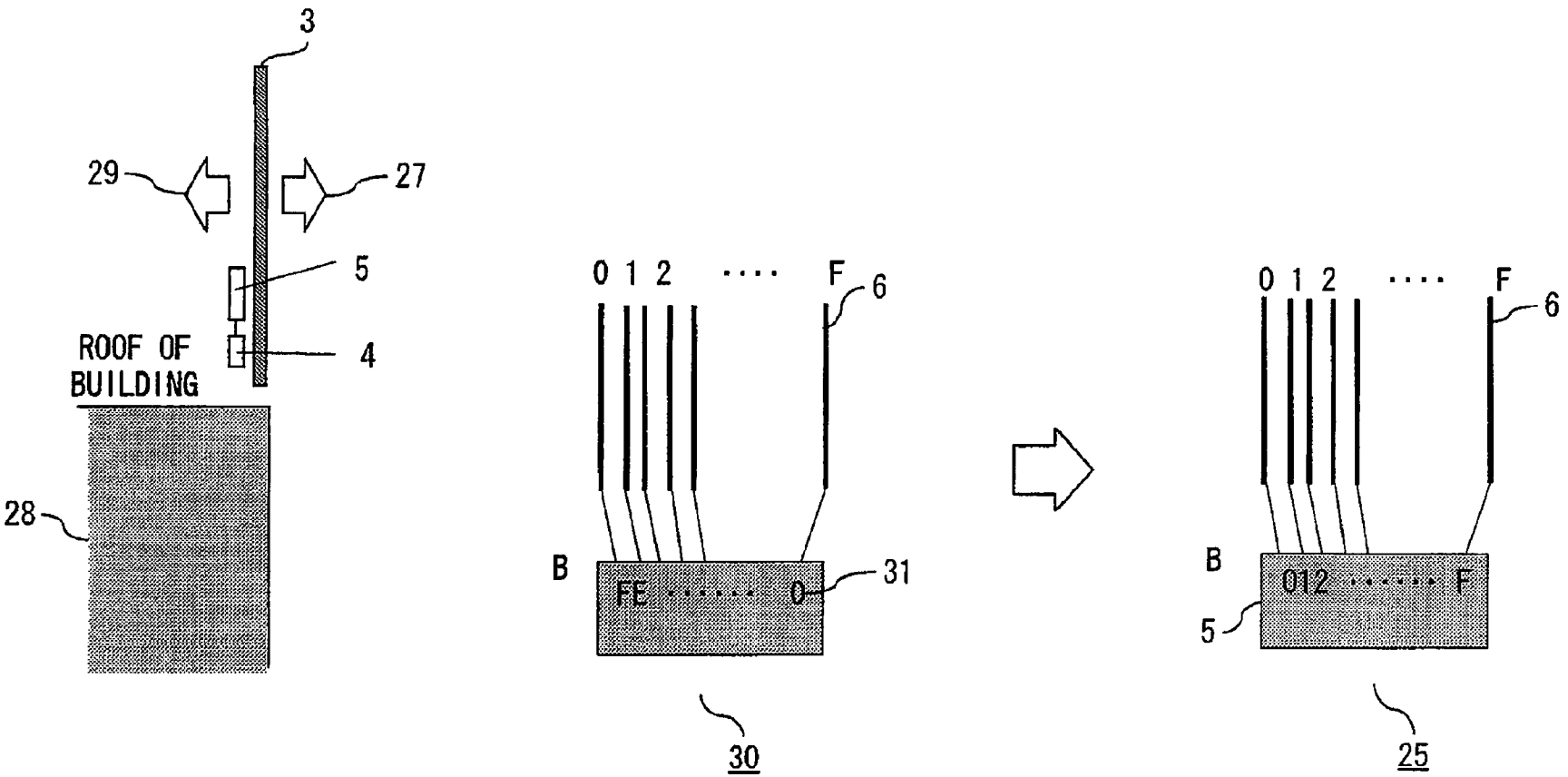
FIG. 10 shows an example installation with the board-B mounted onto a display apparatus with the front facing backward.

FIG. 10 shows an example installation with the board-B 25 being mounted with the front facing backwards. When installing a display apparatus on the roof of a building for example, the maintenance of the board-A 4 and board-B 5 will be performed from the rear surface 29 of the display apparatus. Therefore, the board-B 5 is to be mounted as the board-B 25 being installed with the front facing backwards vis-à-vis the display apparatus. In this case the reversing switch 21 of the board-B 5 is set for the reverse mode.

Here, the board-B 24 being installed with the front facing forward can be changed to a board-B 25 being installed with the front facing backwards just by switching the reversing switch 21 of the board-B. That is, if the board-B 5 is installed with the front facing backwards 29 vis-à-vis the display apparatus (i.e., a state of board-B 24 when forward mounted), the display block 30 viewed from the display surface 27 is in a state of the position of the channel 31 of each lamp unit being reversed. Therefore, if it is attempted to display a screen image in this state, the display will be performed in ascending sequence, beginning with the lamp unit connected to the channel 0 (zero), resulting in displaying the image from the right within the current display block. Then, switching the reversing switch 21 switches the channels of the board-B so it becomes a board-B 25 mounted in reverse, hence making it possible to display the screen image signal from the right to left in the display screen.

Switching the reversing switch 21 can be carried out by not only a dip switch, et cetera, manually, but also automatically. For example, a detection of obstacles such as a wall behind the display apparatus by using an optical sensor, pressure sensor, et cetera, to switch the reversing switch 21 is possible.

Figure 11:
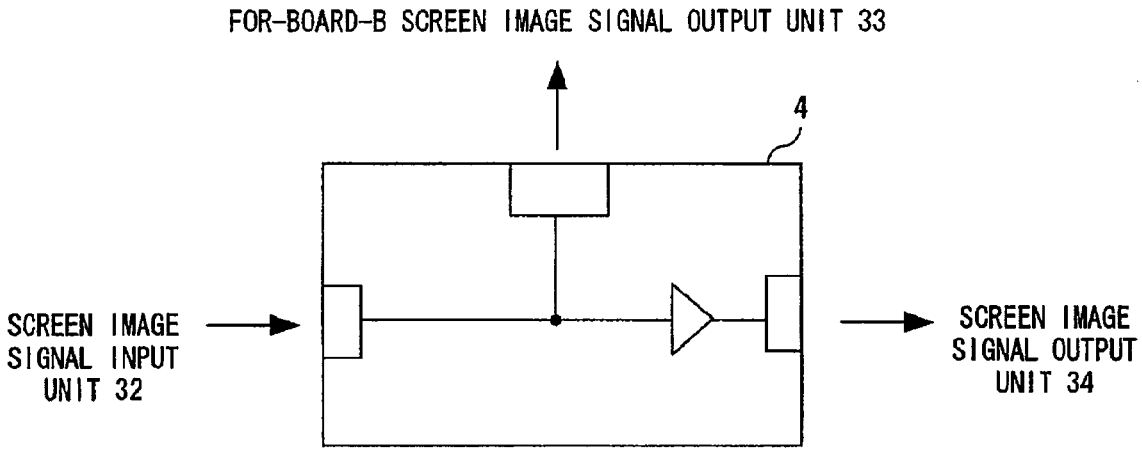
FIG. 11 shows an example comprisal of board-A used in an embodiment according to the present invention.

FIG. 11 shows an example comprisal of the board-A 4 used for an embodiment according to the present invention. A screen image signal from a master control 1 or the previous stage display block is inputted to a screen image signal input unit 32 by way of the signal line 2. The inputted screen image signal is outputted from a for-board-B screen image signal output unit 33 and transferred to the board-B. At the same time, the inputted screen image signal is also outputted from a for-next stage display block screen image signal output unit 34 and transferred to a display block on the next stage.

The board-A 4 used for the present embodiment is simplified as described above so as to suppress fault occurrence and reduce maintenance work.

Figure 12:
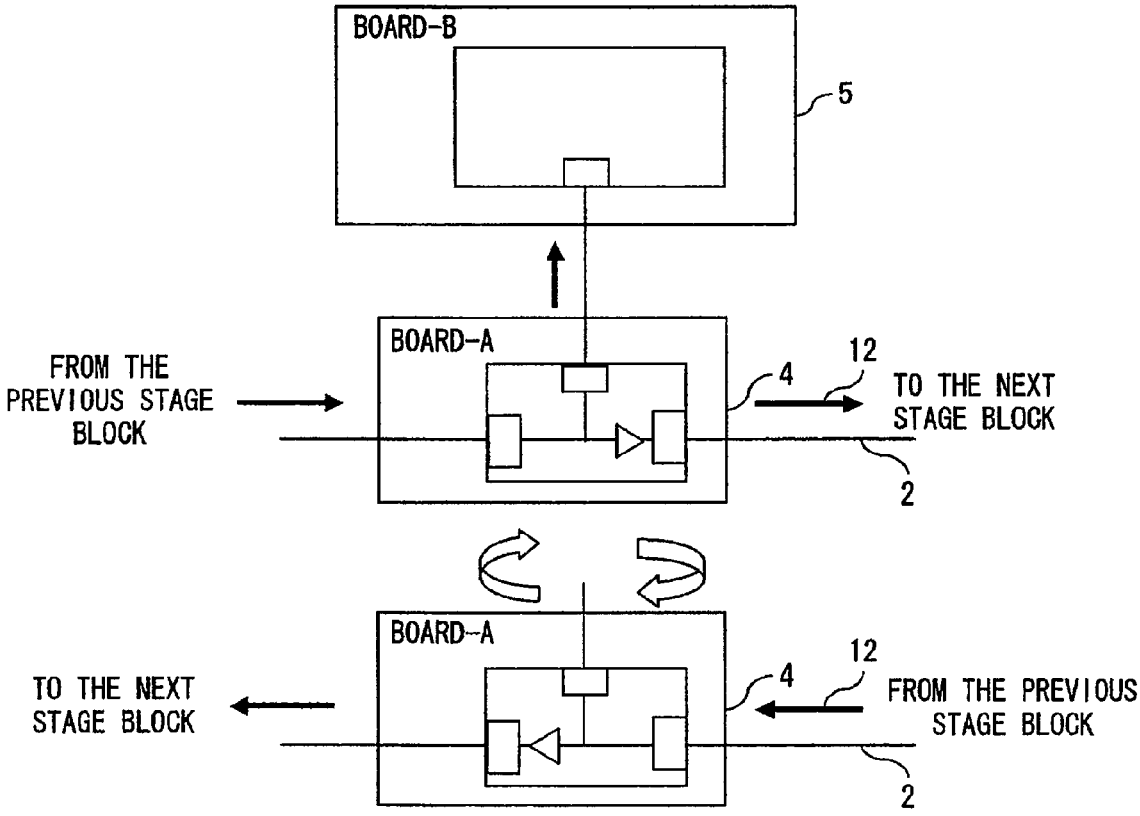
FIG. 12 exemplifies a case of connecting between the boards A and B used in an embodiment according to the present invention.

FIG. 12 shows a case of connecting between the boards A and B. The board-A 4 is connected so as to be reversible vis-à-vis the board-B 5. That is, the board-A is reversed in accordance with the data transmission direction 12 of a screen image signal from the signal line 2, thereby enabling the data transfer direction of the board-A to be changed.

Figure 13:
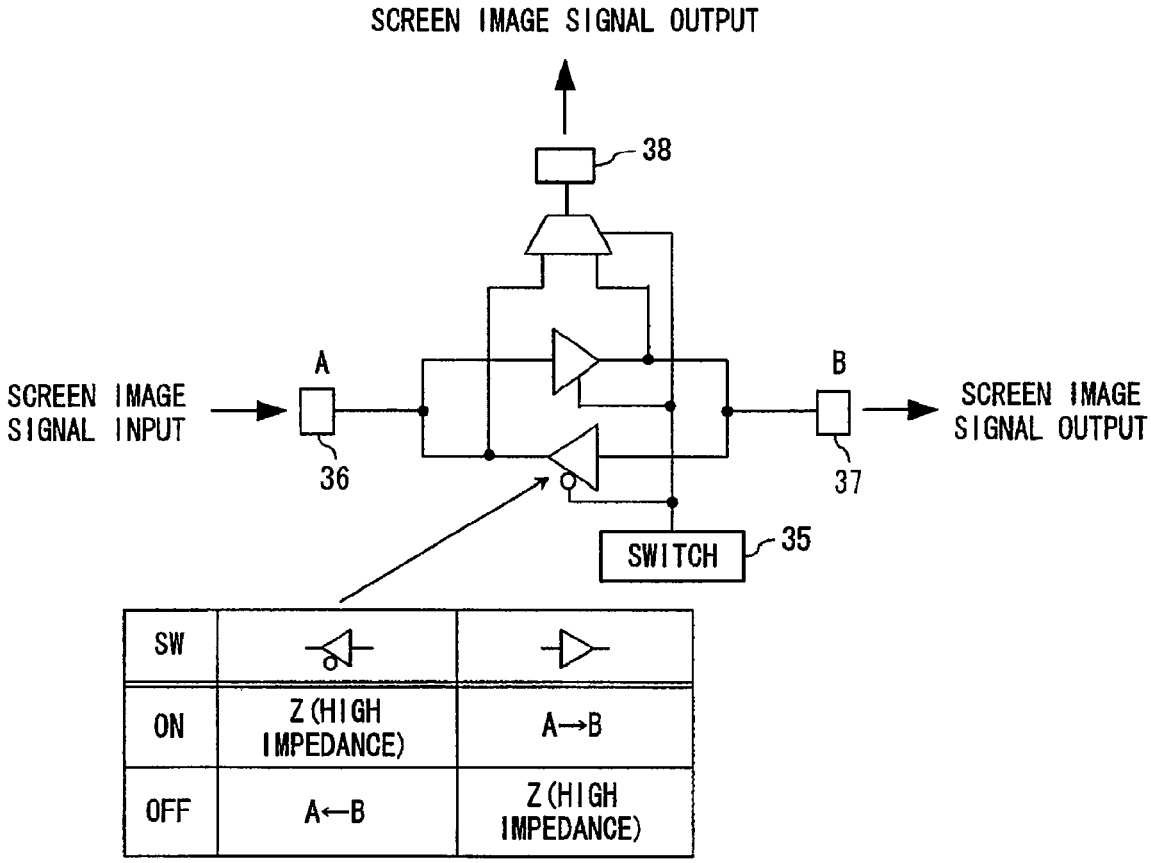
FIG. 13 exemplifies another case of connecting between the boards A and B used in an embodiment according to the present invention.

Here, it is not required to mount the board-A 4 in reverse. That is, the data transfer direction may be changed by switching circuits in accordance with the data transmission direction 12 as shown by FIG. 13 which exemplifies a comprisal in the case of changing data transfer directions by a switch 35, i.e., switching means. Specifically, when turning on the switch 35, a screen image signal inputted from a screen image signal I/O unit A 36 is outputted therefrom to a screen image signal I/O unit B 37, and from the screen image signal I/O unit A 36 to a for-board-B screen image signal output unit 38. When turning off the switch 35, a screen image signal inputted from the screen image signal I/O unit B 37 is outputted therefrom to the screen image signal I/O unit A 36, and from the screen image signal I/O unit B 37 to a for-board-B screen image signal output unit 42.

Figure 14:
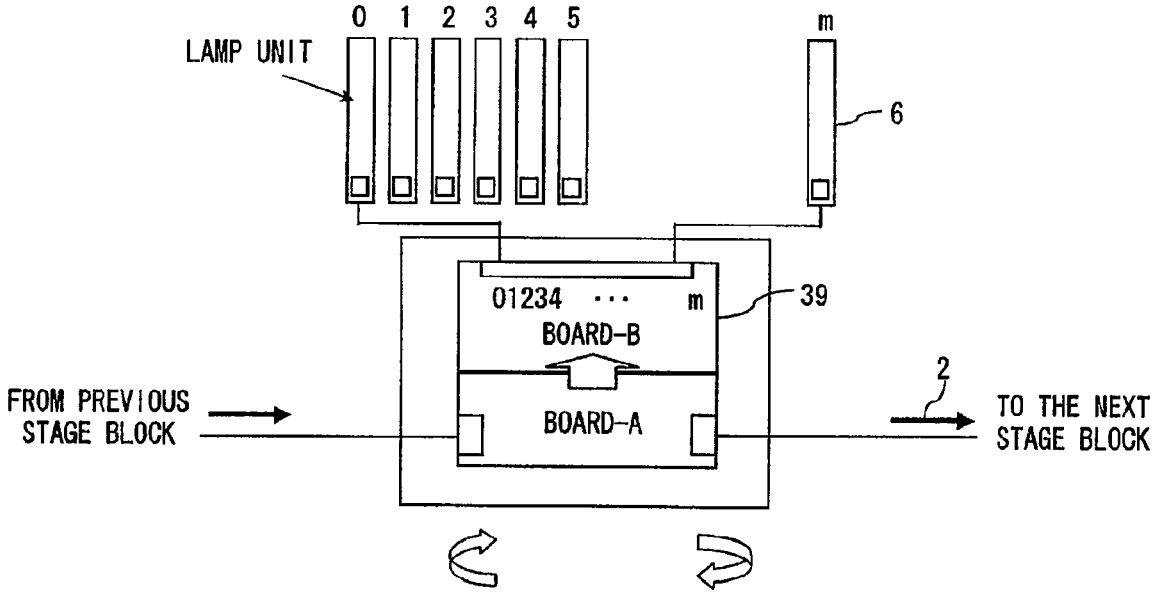
FIG. 14 exemplifies yet another case of connecting between the boards A and B used in an embodiment according to the present invention.
Figure 15:
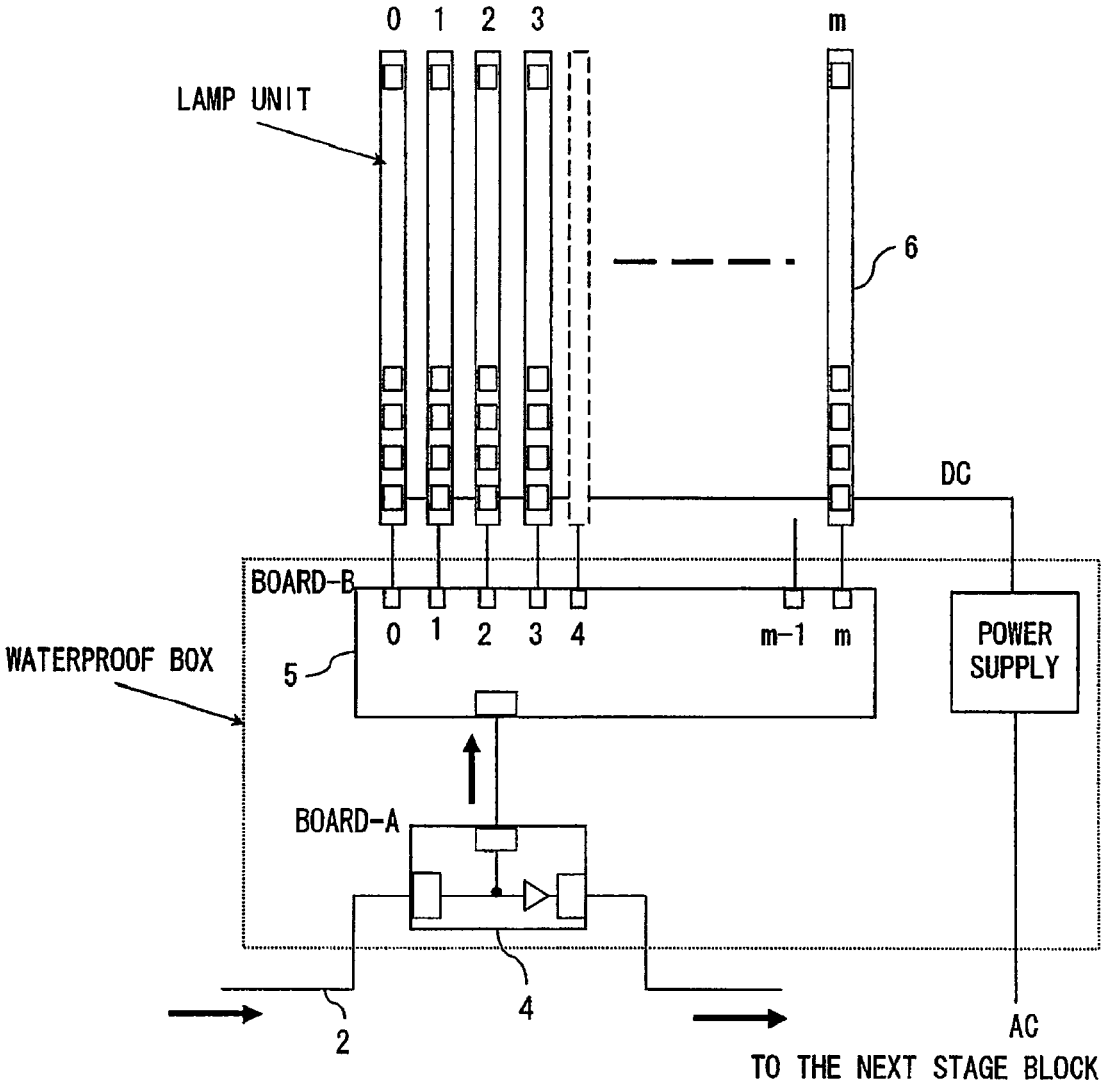
FIG. 15 exemplifies still another case of connecting between the boards A and Bused in an embodiment according to the present invention.

Incidentally, boards for the board-A and board-B are not necessarily to be mutually independent. For example, a board-A part and board-B part may co-reside on one board-AB 39 as shown by FIG. 14. In this case, changing data transfer direction can be carried out merely by reversing the board-AB in accordance with a data transmission direction 12.

Since the board-A 4 and board-B 5 are independent of the lamp unit 6, housing only the board-A, board-B and power supply unit in a waterproof case will easily secure water resistance.

And, since the board-A 4 allows a change of data transfer direction in accordance with the data transmission direction 12, the master control 1 for transmitting a screen image signal is released from the limitation of installation position.

Figure 16A:
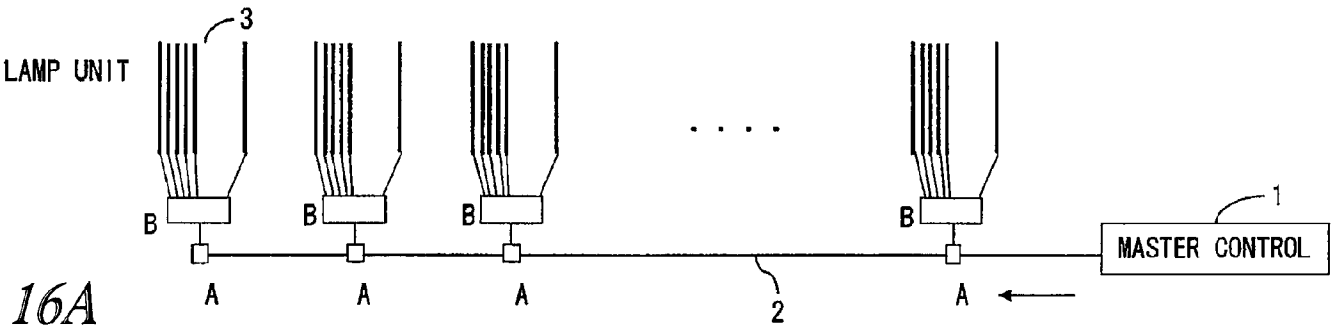
FIGS. 16A, 16B and 16C exemplify a display apparatus in the case of changing an installation position of the master control.
Figure 16B:
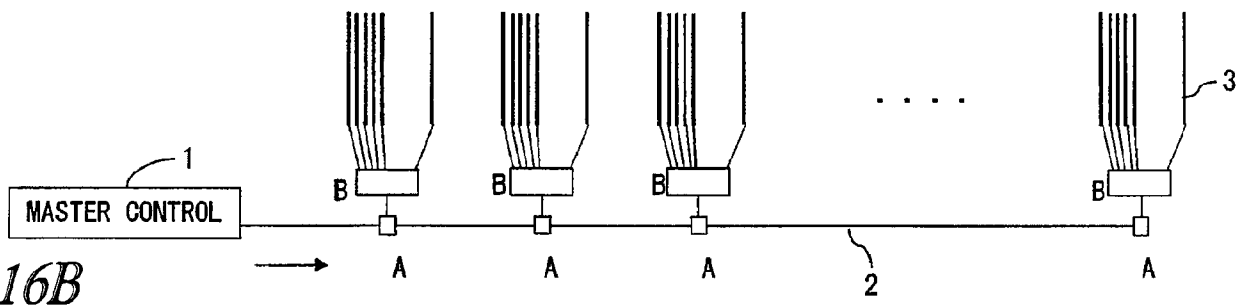
Figure 16C:
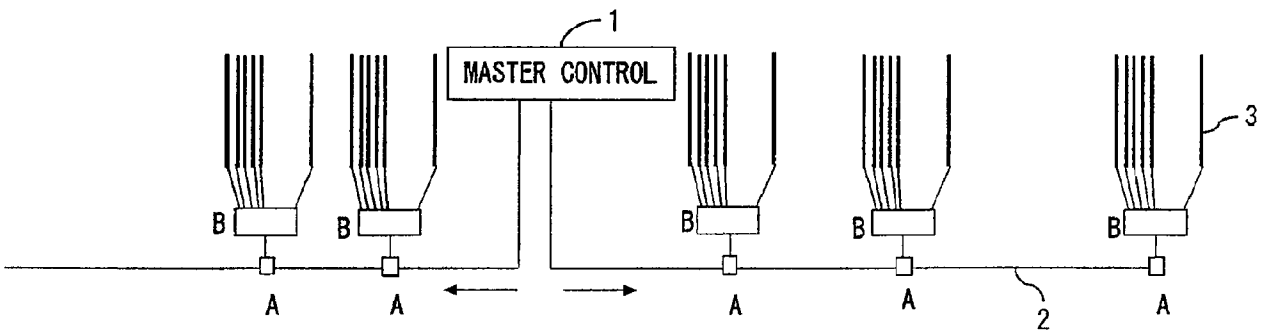
Figure 17:
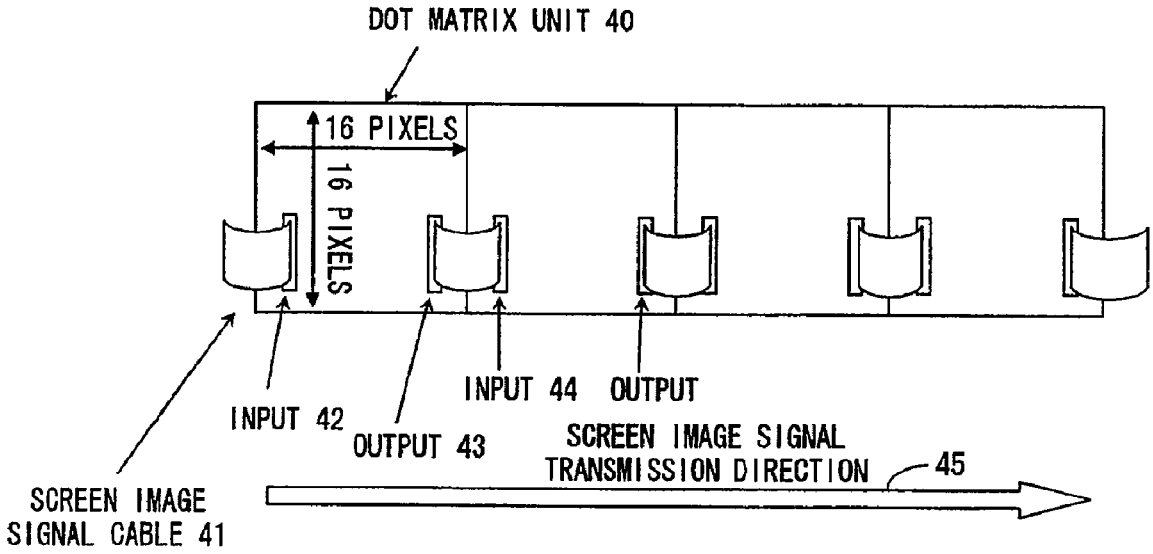
FIG. 17 (PRIOR ART)
FIG. 17 shows an example comprisal of conventional large scale display apparatus.
Figure 18:
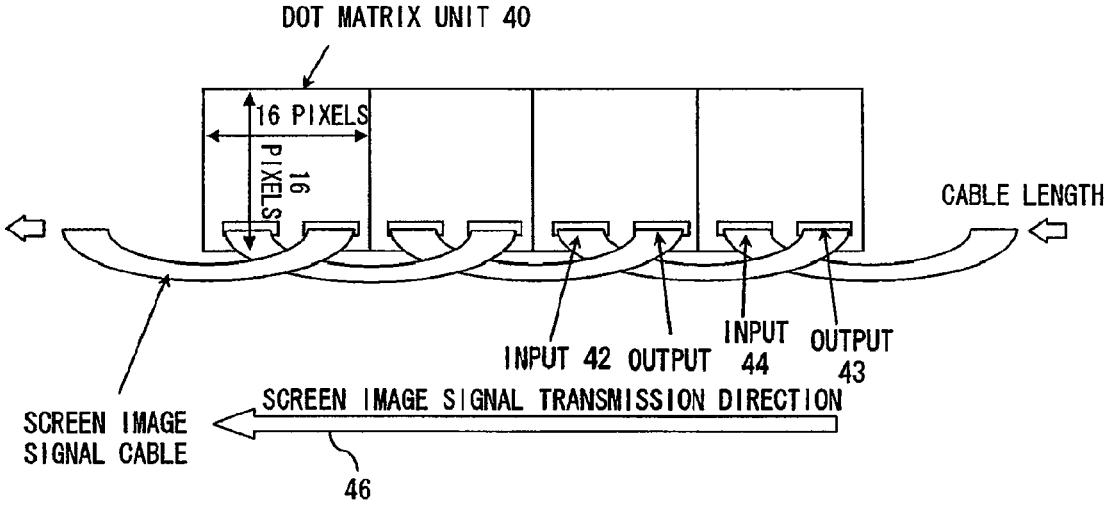
FIG. 18 (PRIOR ART)
FIG. 18 shows an example comprisal of a conventional large scale display apparatus in the case of reversing a transmitting direction of screen image signal.
Figure 19:
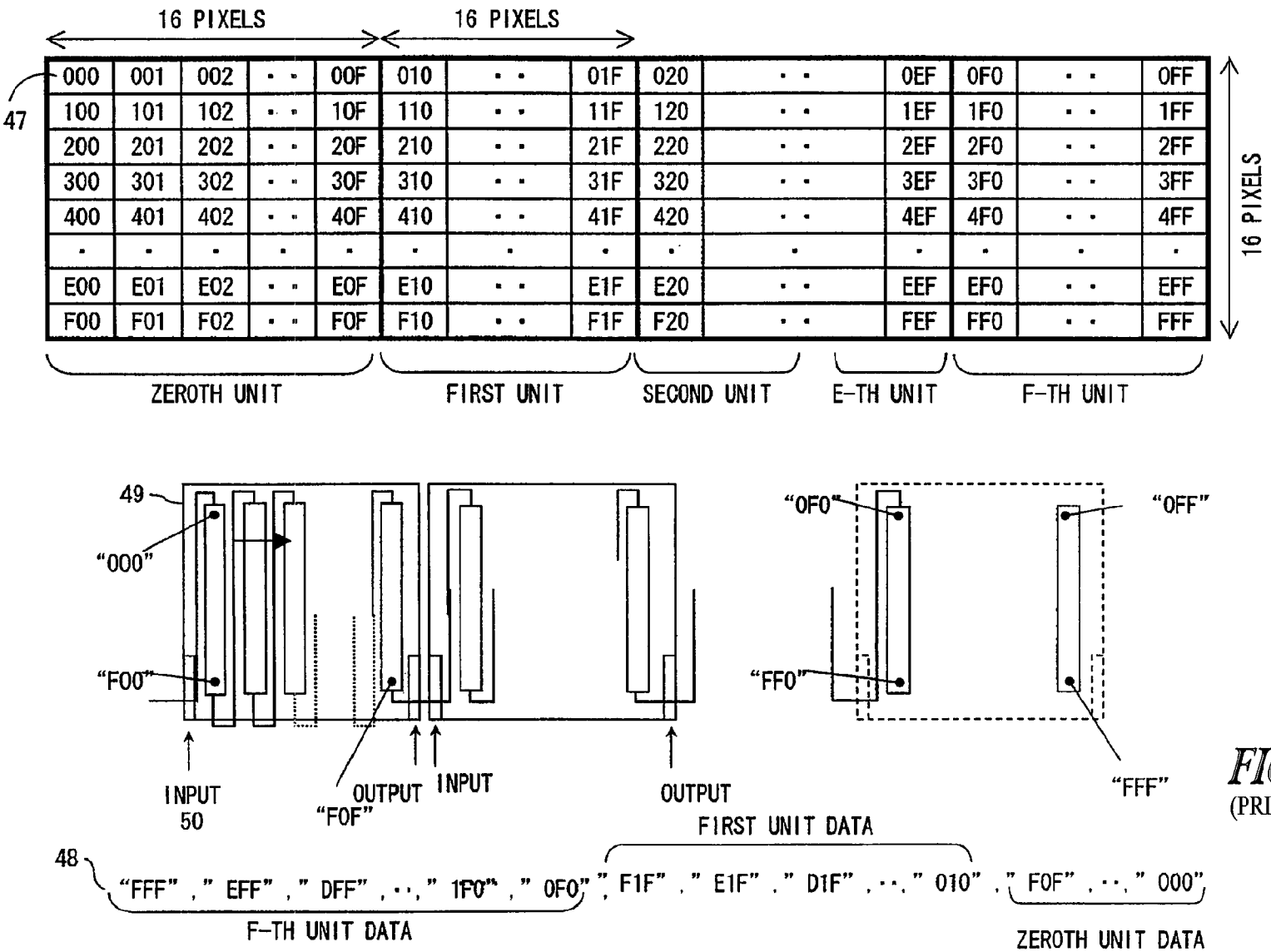
FIG. 19 (PRIOR ART)
FIG. 19 exemplifies a data format for a screen image signal fed into a display apparatus which uses sixteen units of the dot matrix units shown by FIG. 17.

FIG. 16A~16C exemplifies a display apparatus in the case of changing an installation position of the master control 1. FIG. 16A shows the case of installing the master control 1 to the right of the display apparatus, that is, the case of the screen image signal traveling from the right to left via the signal line 2. And, FIG. 16B shows the case of installing the master control 1 to the left of the display apparatus, that is, the case of the screen image signal traveling from the left to right via the signal line 2. The installation configurations between FIG. 16A and 16B can easily be altered by changing the position setup switch 21 comprised by the board-B.

FIG. 16C is the case of connecting the signal line 2 with the two channels of the master control 1 and installing the master control 1 so as to divide one channel thereof shown by FIG. 16A or 16B into two.

According to the present invention, signal supply means and signal transfer means equipped in each display block provide a flexibility of transfer direction of a screen image signal for displaying a character or screen image. If a screen image signal transferred from the master control is transferred in either the rightward or leftward direction vis-à-vis a display apparatus, accurate and easy transfer of a screen image signal to a display block and lamp unit, i.e., light emitting module, is enabled. Furthermore, it is possible to solve the problem caused by reversing input and output cables, and the problem of installation space, which arise when reversing the transfer direction of a screen image signal of a conventional display apparatus.

As for the signal transfer means, having only the function of transmitting a screen image signal reduces a failure rate to an extremely low value, and suppresses the area of a lamp unit failure to a minimum even when there is a fault occurrence such as in a lamp unit or a signal supply means in a transfer path.

What is claimed is:

1. A screen image display apparatus comprising a plurality of display blocks arrayed in a prescribed direction with each of the plurality of display blocks including a plurality of light emitting modules, comprising, for each of the display blocks:

a signal supply unit to supply serially the plurality of light emitting modules with a signal so as to let the light emitting modules display a character or image;

a signal transfer unit to transfer the signal supplied for one display block to the signal supply unit for the one display block and another of the display unit;

wherein the signal supply unit comprises:

a first signal supply unit to supply the light emitting module with the signal transferred from one transfer direction, a second signal supply unit to supply the light emitting module with the signal transferred from another transfer direction; and a switching unit to switch between the first and second signal supply units, wherein said switching unit comprises an optical sensor for detecting whether or not there is an obstacle close to the rear surface of said display apparatus, wherein either said first or second signal supply unit is switched on automatically based on a signal detected by the optical sensor.

2. The screen image display apparatus according to claim 1 further comprising a memory for obtaining and recording the signal.

3. The screen image display apparatus according to claim 2 further comprising a drive IC circuit for making the plurality of display blocks display the signal recorded in the memory.

4. The screen image display apparatus according to claim 1 further comprising a plurality of channels for connecting the plurality of light emitting modules.

5. A screen image display apparatus comprising a plurality of display blocks arrayed in a prescribed direction with each of the plurality of display blocks including a plurality of light emitting modules, comprising, for each of the display blocks:

a signal supply unit for supplying serially the plurality of light emitting modules with a signal so as to let the light emitting modules display a character or image; and a signal transfer unit for transferring the signal supplied for one display block to the signal supply unit for the one display block and another of the display units, wherein the signal supply unit comprises:

a first signal supply unit for supplying the light emitting module with the signal transferred from one transfer direction, a second signal supply unit for supplying the light emitting module with the signal transferred from another transfer direction, and a switching unit for switching between the first and second signal supply units, wherein said switching unit comprises a pressure sensor for detecting whether or not there is an obstacle on the rear surface of said display apparatus, wherein either said first or second signal supply unit is switched on automatically based on a signal detected by the pressure sensor.

6. The screen image display apparatus according to claim 5 further comprising a memory for obtaining and recording the signal.

7. The screen image display apparatus according to claim 6 further comprising a drive IC circuit for making the plurality of display blocks display the signal recorded in the memory.

8. The screen image display apparatus according to claim 5 further comprising a plurality of channels for connecting the plurality of light emitting modules.

9. A screen image display apparatus forming a display screen by arraying a plurality of display blocks, the display blocks arranging a plurality of light emitting modules in parallel so as to form a portion of the display screen, the plurality of light emitting modules including a plurality of light emitting elements serially arranged, the screen image display apparatus comprising, for each of the display blocks:

a signal supply unit for obtaining screen image signal data, being necessary for an own display block, from a screen image signal that causes the display screen to display a character or image and that is serially transferred, for respectively generating display data to be displayed on each of the light emitting modules by distributing the screen image signal data to each of the light emitting modules, and for supplying each of the light emitting modules with the display data;

a distribution order switching unit for switching order of distributing the screen image signal data to each of the light emitting modules; and a signal transfer unit comprising, a first signal transfer unit for transferring the screen image signal transferred from one transfer direction to the signal supply unit for the own display block and the next display block, a second signal transfer unit for transferring the screen image signal transferred from another transfer direction to the signal supply unit for the own display block and the next display unit, and a transfer direction switching unit for switching between the first and second signal transfer units.

* * * * *